US005685343A

United States Patent [19]

Smith

[11] Patent Number: 5,685,343

[45] Date of Patent: Nov. 11, 1997

[54] DECORATIVE PIPE TUBING COVER

[76] Inventor: Richard D. Smith, 6018 S. Nebraska St., Marion, Ind. 46953

[21] Appl. No.: 678,226

[22] Filed: Jul. 11, 1996

Related U.S. Application Data

[60] Provisional application No. 60/013,780 Mar. 21, 1996.

[51] Int. Cl.[6] ..... F16L 55/115

[52] U.S. Cl. ..... 138/89; 138/96 R; 138/109; 166/94.1; 166/75.13; 248/146

[58] Field of Search ..... 138/89, 89.1, 89.2, 138/89.3, 89.4, 96 R, 109; 248/146; 206/501, 502; 220/212, 380; 215/228, 393, 395; 166/79.1, 94.1, 93.1, 75.13

[56] References Cited

U.S. PATENT DOCUMENTS

| | | | |
|---|---|---|---|
| D. 350,003 | 8/1994 | Rentz . | |
| 1,337,222 | 4/1920 | Harned | 220/212 |
| 1,721,805 | 7/1929 | Cormier | 166/69 |
| 1,774,569 | 9/1930 | Shrum | 138/96 T |
| 1,877,098 | 9/1932 | Washburn | 248/146 |
| 1,893,993 | 1/1933 | Hirsch . | |
| 2,226,233 | 12/1940 | Sharpiro | 138/89 |
| 2,601,820 | 7/1952 | Paul et al. | 138/89 |
| 3,756,314 | 9/1973 | Valley | 138/96 R |
| 3,963,054 | 6/1976 | Martin | 138/89 |
| 3,993,102 | 11/1976 | Polster et al. | 138/96 T |
| 4,023,699 | 5/1977 | Lien | 166/75.13 |
| 4,457,448 | 7/1984 | Beagell | 166/75.13 |
| 4,848,458 | 7/1989 | Holdsworth et al. . | |
| 4,972,905 | 11/1990 | Henson . | |
| 5,184,608 | 2/1993 | Hale, III . | |
| 5,199,213 | 4/1993 | Krebs et al. | 248/146 |
| 5,332,196 | 7/1994 | Wright . | |
| 5,368,074 | 11/1994 | Hall . | |
| 5,623,971 | 4/1997 | Foernzler | 138/89 |

FOREIGN PATENT DOCUMENTS

| | | |
|---|---|---|
| 672432 | 10/1963 | Canada . |
| 2705719 | 12/1994 | France . |
| 867188 | 6/1952 | Germany . |
| 521303 | 5/1940 | United Kingdom . |
| 1133816 | 11/1968 | United Kingdom . |
| 2102466 | 2/1983 | United Kingdom . |
| 2260550 | 4/1993 | United Kingdom . |

*Primary Examiner*—David Scherbel
*Assistant Examiner*—James F. Hook
*Attorney, Agent, or Firm*—Richard C. Litman

[57] ABSTRACT

A well pipe end cap attached to the top of a well pipe extending from the ground. The well pipe end cap includes a platform for supporting lawn decorations or accessory items. Items such as birdhouses, flags, or potted plants are supported for decoration, whereas items such as lawn tools, or mailboxes are supported for utilitarian or accessory uses. The platform and cap are coupled via a shaft. The ends of the shaft are threadingly or adhesively received into both the cap and the platform. The present invention further serves the function of identifying and locating the well pipe end in a sure and easy manner. The invention also integrates an electrical wire conduit end cap for well pipe ends that have associated conduit carrying the conductors of a subsurface water pump.

8 Claims, 5 Drawing Sheets

DECORATIVE PIPE TUBING COVER

CROSS REFERENCE TO RELATED APPLICATIONS

This application is based on provisional application Ser. No. 60/013,780 filed on Mar. 21, 1996.

BACKGROUND OF THE INVENTION

1. Field of the Invention

The present invention relates to caps for pipes, and more particularly to well caps having the ability to support various decorative or utilitarian lawn items.

2. Description of Prior Art

Numerous devices are known for covering pipe ends, or fence posts, for preventing entry of contaminants and/or for decorative, aesthetic purposes. Such devices are found in the following: U.S. Pat. No. 4,848,458, issued Jul. 18, 1989, to Holdsworth et al.; U.S. Pat. No. 1,721,805, issued Jul. 25, 1929, to Cormier; U.S. Pat. No. Des. 350,003, issued Aug. 23, 1994, to Rentz; U.S. Pat. No. 1,893,993, issued Jan. 10, 1933, to Hirsch; U.S. Pat. No. 4,972,905, issued Nov. 27, 1990, to Henson; U.S. Pat. No. 5,184,608, issued Feb. 9, 1993, to Hale, III; U.S. Pat. No. 5,332,196, issued Jul. 26, 1994, to Wright; U.S. Pat. No. 5,368,074, issued Nov. 29, 1994, to Hall; U.K. Patent Document No. 2,260,550, published Apr. 21, 1993 to Connolly; U.K. Patent Document No. 2,102,466, published Feb. 2, 1983 to Bannister; U.K. Patent Document No. 1,133,816, published Nov. 20, 1968; U.K. Patent Document No. 521,303, published May 17, 1940 to Stevenson; France Patent Document No. 2,705,719, published Dec. 2, 1994 to Maisonneuve, discloses a post hole cap for preventing plants from growing into the post hole; Canada Patent Document No. 672,432, published Oct. 15, 1963 to Walker; and Germany Patent Document No. 867, 188, published Jun. 11, 1952 to Lindlar, discloses a pipe end closure for sealing the exposed end of a pipe from external entry.

None of the above inventions and patents, taken either singly or in combination, is seen to describe the instant invention as claimed.

SUMMARY OF THE INVENTION

Accordingly, it is a principal object of the invention to provide a cap for well pipes.

Also, it is another principal object of the invention to provide a cap for well pipes having a conduit for electric water pump conductors.

It is another object of the invention to provide a secure cap for well pipes.

It is yet another object of the invention to provide a secure cap for well pipes having a conduit for electric water pump conductors.

It is a further object of the invention to provide a secure cap for well pipes having appealing aesthetic properties.

Still another object of the invention is to provide a secure cap for well pipes having utilitarian properties.

It is still an additional object of the invention to provide a secure cap for well pipes having a conduit for electric water pump conductors and having appealing aesthetic and/or utilitarian properties.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
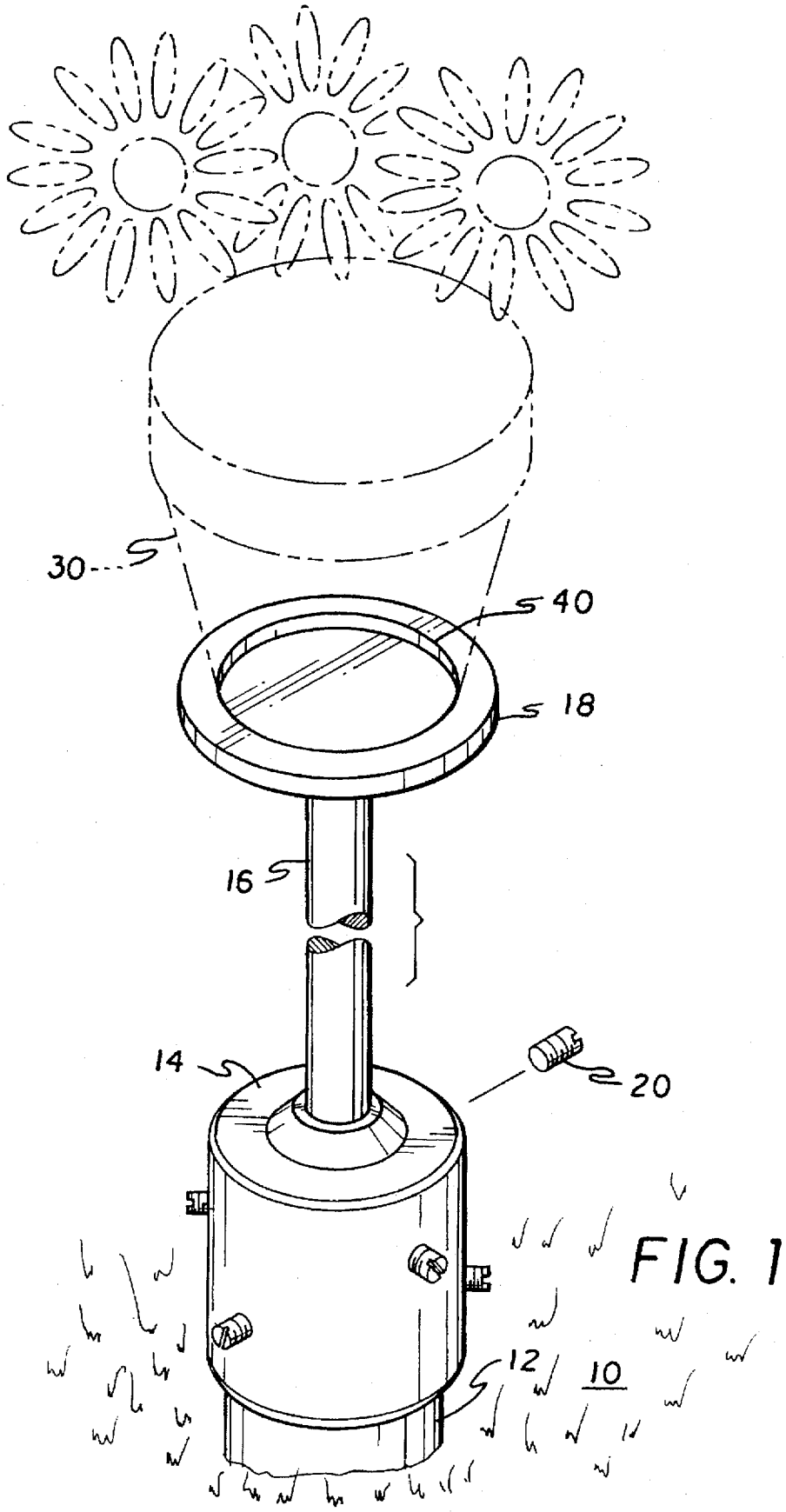
FIG. 1 is an environmental perspective view of the invention having an optional decorative item placed thereon.
Figure 2:
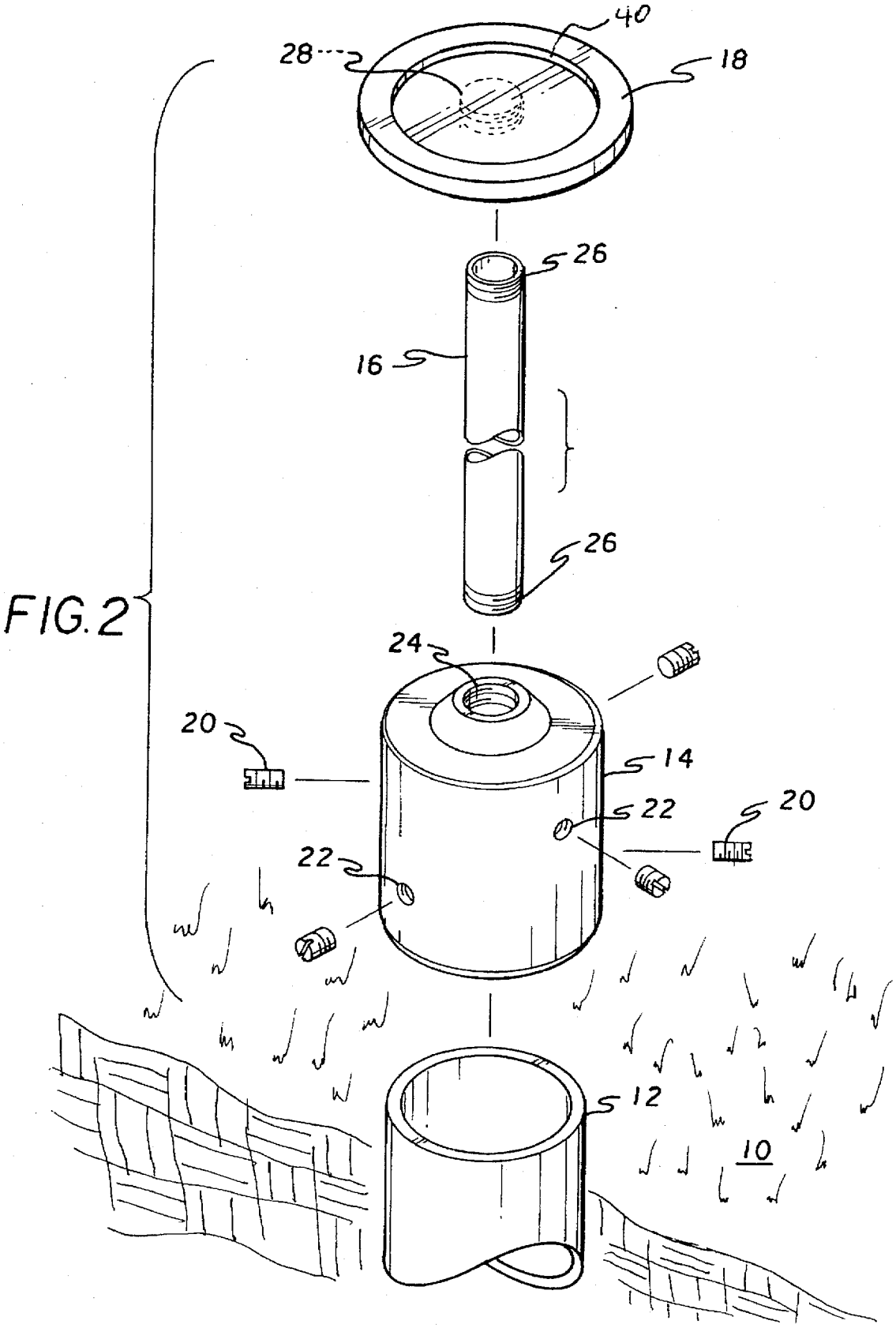
FIG. 2 is an exploded perspective view showing the construction of the invention.
Figure 3:
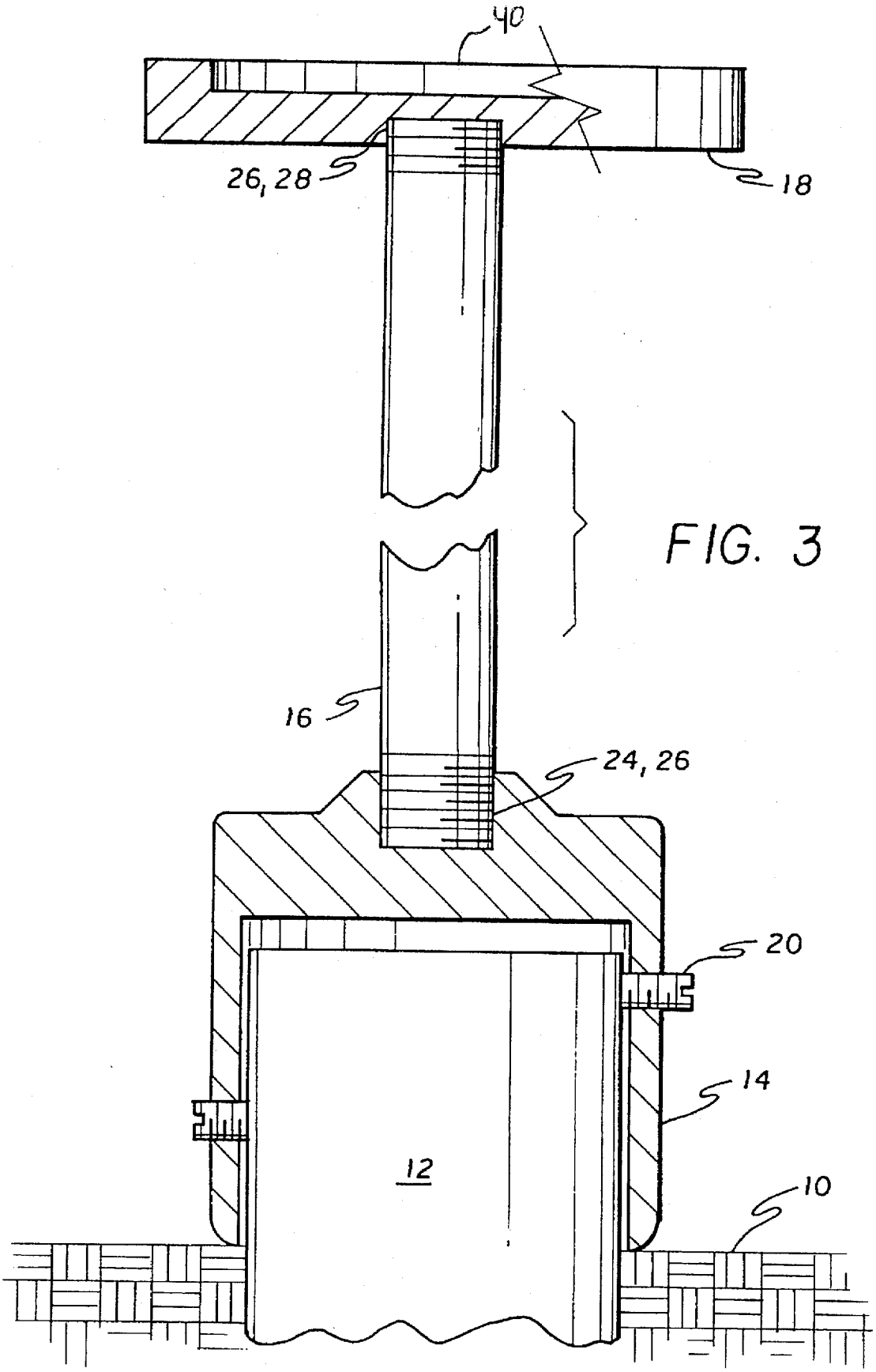
FIG. 3 is an elevational cross section view of the invention installed on the well pipe.

For the purposes of promoting an understanding of the principles of the invention, reference will now be made to the embodiment illustrated in the drawings and specific language will be used to described the same. It will nevertheless be understood that no limitation of the scope of the invention is thereby intended, such alterations and further modifications in the illustrated well cap, and such further applications of the principles of the invention as illustrated therein being contemplated as would normally occur to one skilled in the art to which the invention relates. Referring to FIGS. 1–3, an otherwise unattractive well pipe end 12 protrudes from the ground surface 10, causing an eyesore to the property. The need for the well pipe end 12 to extend above the ground surface is recognized as preventing ground runoff from entering the well, as well as preventing an innocent passerby from getting a heel or toe of a foot caught or injured. Consequently, the well pipe end 12 must extend above the ground surface. Typically, the length of the extended portion of well pipe is in the range of 4 to 12 inches.

The present invention removes all negative impressions promulgated by the well pipe. For example, a rural home may have a fantastic sloping front yard ready for landscaping; however, due to the water table, a well pipe exists in the center of the yard. The well pipe presents an eyesore and a dilemma to the landscaper. The instant invention provides a solution to this dilemma and as such improves the ability of the landscaper to create a natural piece of art.

In FIG. 1, extending from the ground 10 is a well pipe end Mounted upon the well pipe end 12 is a cap 14 which also serves as the base of the present invention. The cap 14 is a cylinder having an inner diameter that is equal to or slightly greater than the outer diameter of the well pipe end 12. The cap 14 fits over the top of the well pipe end 12, sealing the pipe from contaminants and intruders (e.g., pests and rodents).

FIG. 2 provides a clearer understanding of the construction of the present invention. The cap 14 is secured to the well pipe end by a series of set screws 20, preferably 6, arranged circumferentially around the cap 14 in an alternating manner. The set screws 20 are seated in tapped or self-tapping holes 22 located in the cap 14. The set screws 20 provide the necessary security for the base of the invention as well as functioning to maintain the cap 14 on the well pipe end 12.

Located in the center of the top of cap 14 is a receiving hole or socket 24. The receiving hole 24, in the preferred embodiment, is threaded. However, a through hole, a post-type hole, or a "V-shaped" hole, as well as many others, are also inherent within the scope of the invention. Receiving hole 24 matingly accepts one end 26 of shaft 16. Shaft 16 extends from the cap 14 a distance in the range of one to eight feet. In the preferred arrangement, the shaft 16 is five feet in length. Both ends 26 of shaft 16 are identical, thereby allowing either end 26 to matingly engage the receiving hole 24 of cap 14.

Atop shaft 16, a platform 18 is positioned. The platform 18, in the preferred embodiment, is substantially planar circular in shape. However, any geometrical configuration is suited so long as equilibrium is maintained. The platform 18 also has a receiving hole or socket 28 for matingly accepting the other end 26 of shaft 16. Like receiving hole 24 of cap 14, receiving hole 28 of platform 28 is threaded. However, a through hole is also inherent within the scope of the invention. Additionally, the platform 18 has a recess 40 in the top thereof. The recess 40 provides a secured surface upon which objects are removably positioned. Likewise, the recess 40 allows the platform 18 to include permanent attachment of objects place thereon, e.g., screw type fasteners, snap type fasteners, adhesives, etc. FIG. 3 is a cross-section of the first embodiment. As can be seen, the recess 40 of platform 18 extends to a depth on the order of 33% of the thickness of platform 18. In addition, the threaded hole 28, for receiving the threaded end 26 of shaft 16, is also on the order of 33% of the thickness of the platform 18. Further, the recess 40 is dimensioned relative to the diameter of well pipe 12, such that the diameter of the recess 40 is relatively the same as the outer diameter of the pipe 12.

As can be seen from FIG. 1, the invention provides a closure to the well pipe end 12, as well as establishing a platform for enhancing the surrounding area by supporting decorative additions. For example, the potted plant 30 in FIG. 1 is supported on the platform 18. The decorative enhancements, e.g., potted plant 30 (or other suitable type items such as birdhouses, flags, or figurines), may be positioned in recess 40 on the top of platform 18 in any conventional manner. That is, the decorative enhancements may be set atop of, adhesively attached to, or mechanically anchored to the platform.

Figure 4:
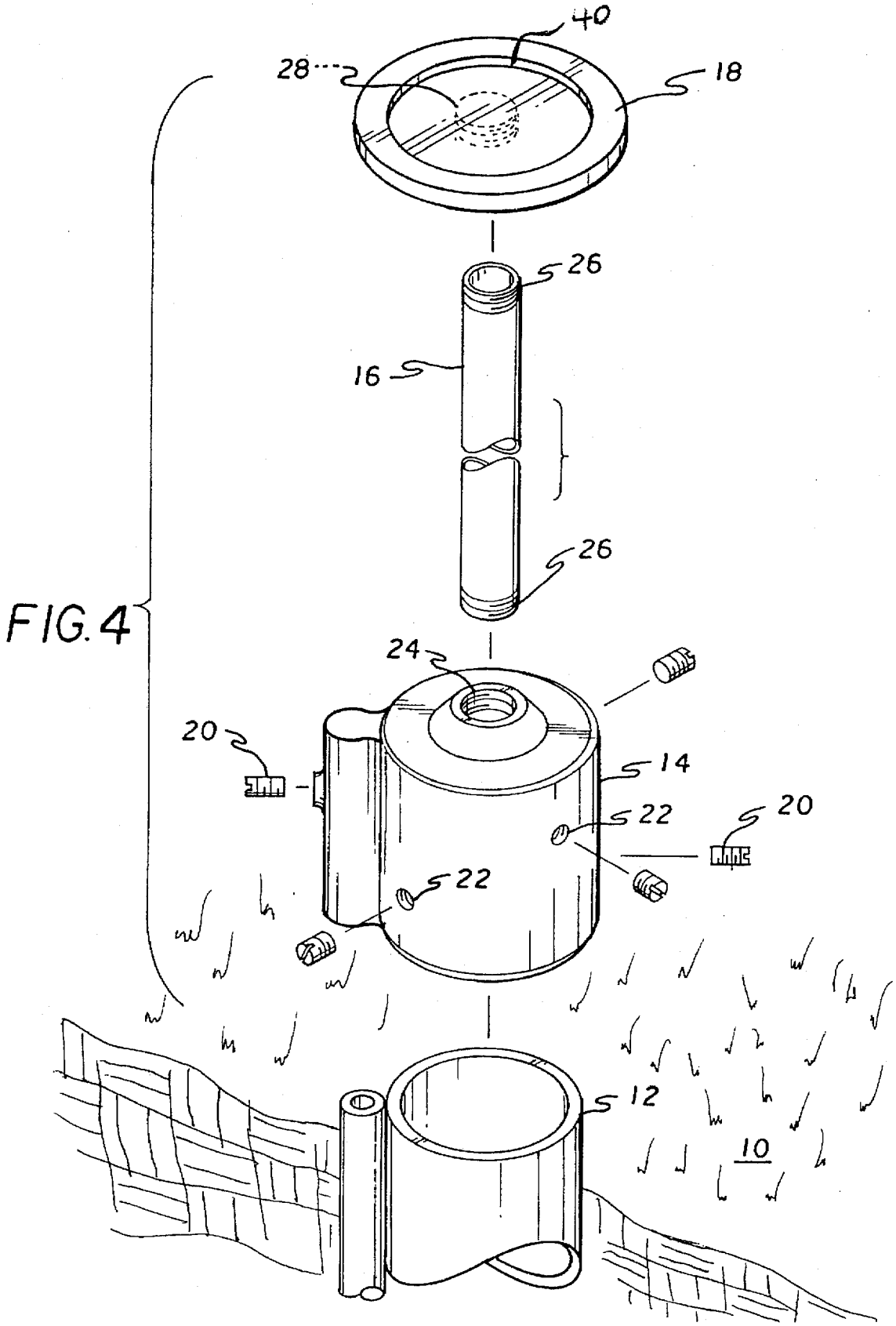
FIG. 4 is an exploded perspective view showing the construction of the invention of another embodiment having an electrical conduit.
Figure 5:
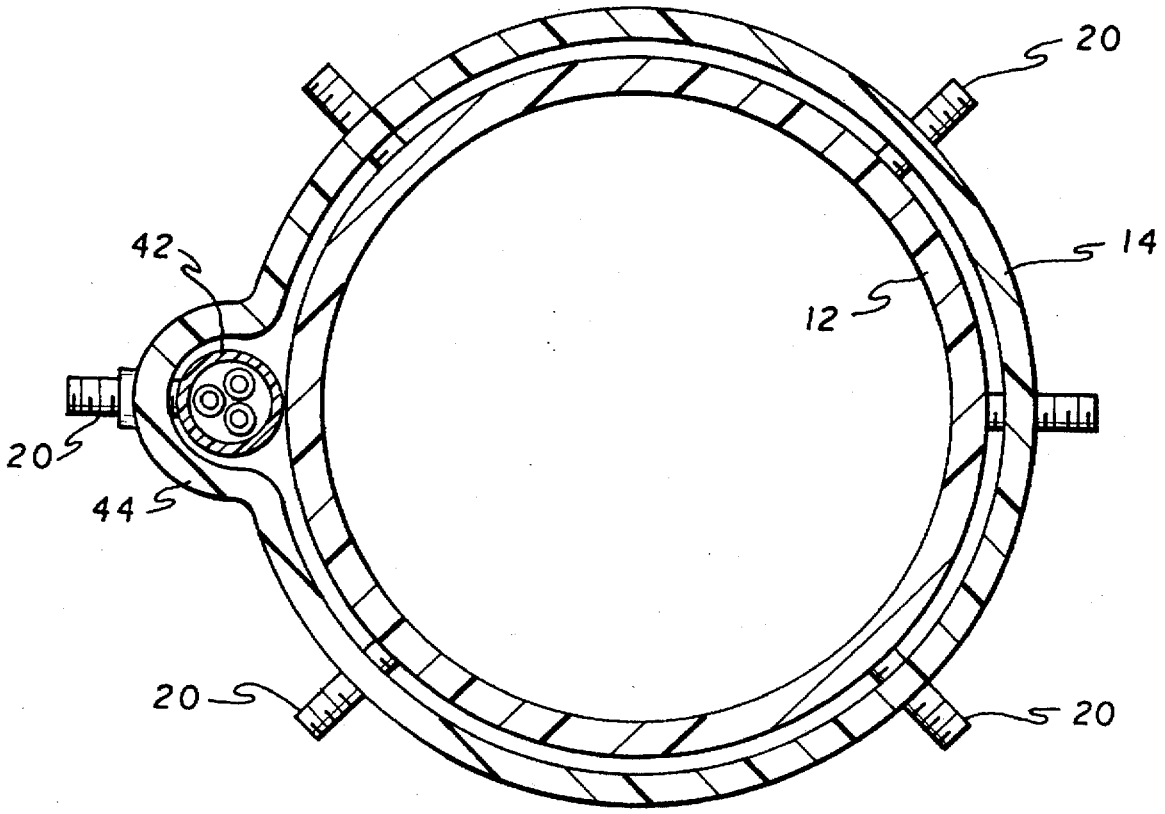
FIG. 5 is a cross-sectional view of the embodiment of FIG. 4 taken along line 5—5.

Looking now to FIGS. 4 and 5, another preferred embodiment is shown. This embodiment provides an additional capping for an electrical conduit 42 disposed parallel and adjacent to well pipe 12. The conduit 42 provides the path for electrical wires (not shown) that supply electrical power to a subsurface water pump (not shown). Cap 14 has a corresponding extension 44 that covers the conduit 42. The extension 44 is integral with the cap 14 and forms a virtually impervious barrier over the openings of both the well pipe 12 and the conduit 42. As seen from FIGS. 4 and 5, the cap 14 having the extension 44 completely encircles the both the pipe 12 and the conduit 42 unitarily. The cap 14, with extension 44, is secured to the pipe 12 and conduit 42 in the manner discussed above by the set screws 20, threadedly received in holes 22.

Although not shown, the platform 18 can also function in a utilitarian mode. Items such as lawn tools, newspaper boxes or mailboxes, and/or name and address plates may be supported or suspended from the platform 18. In either mode, decorative or utilitarian, the present invention serves an additional function of providing a sure and simple identification and location of the well pipe end 12 extending from the ground surface 10.

While the invention has been illustrated and described in detail in the drawings and foregoing description, the same is to be considered as illustrative and not restrictive in character and scope. For instance, the platform 18 may be omitted and the upwardly extending shaft end 26 may provide adequate support for the decorative or utilitarian item. Also, the present invention has been described with respect to a circular well pipe but could equally and easily be adapted to accommodate well pipe ends having different shaped cross sections such as square or triangular, etc. In addition, is within the spirit and scope of the present invention to adhesively couple the ends 26 of the shaft 16 with the receiving holes in the cap 14 and the platform 18 respectively. Likewise, enhancement of the adhesion is contemplated to include, but not limited to roughening or knurling the ends 26 of the shaft 16. It is to be understood that only the preferred embodiments have been shown and described and that all changes and modifications that come within the spirit and scope of the invention are desired to be protected.

I claim:

1. A closure for a well pipe comprising:

a bottom portion sized to fit over an end of the well pipe, said bottom portion for sealing the well pipe end, said bottom portion including a top surface;

attachment means for securely anchoring said bottom portion to the well pipe end;

a first socket located in said top surface of said bottom portion;

a shaft member having a first end and a second end, said first end fastened within said first socket; and a substantially planar platform having a upper surface and a lower surface, said lower surface having a second socket located therein, said upper surface providing a support surface, said second end of said shaft fastened within said second socket.

2. The closure according to claim 1 wherein said first socket and said second socket each have internal threading, and said first end and second end of said shaft have mating external threading.

3. The closure according to claim 1 wherein said first end and said second end of said shaft are adhesively fastened within said first socket and said second socket respectively.

4. The closure according to claim 1 wherein said upper surface of said platform includes a recess therein for removably securing objects on said upper surface.

5. A closure for a well pipe having an adjacent conduit comprising:

a bottom portion including a main cylindrical portion sized to fit over an end of the well pipe and an extension protruding from said main portion sized to fit over the conduit, said bottom portion for sealing the well pipe end, said bottom portion including a top surface;

attachment means for securely anchoring said bottom portion to the well pipe end;

a first socket located in said top surface of said bottom portion;

a shaft member having a first end and a second end, said first end fastened within said first socket; and a substantially planar platform having a upper surface and a lower surface, said lower surface having a second socket located therein, said upper surface providing a support surface, said second end of said shaft fastened within said second socket.

6. The closure according to claim 5 wherein said first socket and said second socket each have internal threading, and said first end and second end of said shaft have mating external threading.

7. The closure according to claim 5 wherein said first end and second end of said shaft are adhesively fastened within said first and said second sockets respectively.

8. The closure according to claim 5 wherein said upper surface of said platform includes a recess therein for removeably securing objects on said upper surface.

* * * * *